US006015298A

United States Patent [19]

Linhart

[11] Patent Number: 6,015,298

[45] Date of Patent: Jan. 18, 2000

[54] VACUUM-CLEANER HOSE WITH ELECTRICAL CONDUCTORS

[75] Inventor: Georg Peter Linhart, Wöllstadt, Germany

[73] Assignee: Truplast Konststofftechnik GmbH, Langgöns, Germany

[21] Appl. No.: 09/093,893

[22] Filed: Jun. 9, 1998

[51] Int. Cl.[7] ..... H01R 39/00

[52] U.S. Cl. ..... 439/24; 439/191

[58] Field of Search ..... 439/24, 191, 195, 439/192, 193, 194

[56] References Cited

U.S. PATENT DOCUMENTS

| | | | |
|---|---|---|---|
| 4,345,805 | 8/1982 | Finley et al. . | |
| 4,913,657 | 4/1990 | Naito et al. | 439/192 |
| 5,620,210 | 4/1997 | Eyster et al. | 439/192 |

FOREIGN PATENT DOCUMENTS

| | | |
|---|---|---|
| 0288742 | 11/1988 | European Pat. Off. . |
| 0733336 | 9/1996 | European Pat. Off. . |
| 9625083 | 8/1996 | WIPO . |

*Primary Examiner*—Lincoln Donovan
*Assistant Examiner*—J. F. Duverne
*Attorney, Agent, or Firm*—Horst M. Kasper

[57] ABSTRACT

A vacuum-cleaner hose with electrical conductors comprises a hose made of a soft thermoplastic material. A support carrier, made out of a harder material than the material of the hose, is attached at one end of the hose for electrical slip rings. One of the electrical conductors is in each case connected to the slip rings. An end socket is inserted into the end of the hose exhibiting the support carrier, is connected to the support carrier, and is made of the same material as the support carrier. The support carrier is made of a socket ring, provided with at least one slip ring, and a sleeve, disposed in front of the socket ring. The sleeve is provided with a continuous axial slot and includes two additional slip rings, and the sleeve is connected form-matchingly to the socket ring and to the end socket. At least one thread turn is formed at an inner jacket face of the sleeve and forms a counter thread for the wave troughs and the wave crests of the hose. Ends of the electrical conductors are guided out of a protective casing, disposed in the hose, first into the axial slot of the sleeve and then to the slip rings, coordinated to the ends of the electrical conductors and openly disposed inside the axial slot.

8 Claims, 4 Drawing Sheets

VACUUM-CLEANER HOSE WITH ELECTRICAL CONDUCTORS

BACKGROUND OF THE INVENTION

1. Field of the Invention

The invention relates to a vacuum-cleaner hose with electrical conductors, wherein the hose is made of a soft thermoplastic material and exhibits at its outer side spiral, screw-like wave crests and wave troughs.

2. Brief Description of the Background of the Invention Including Prior Art

Such vacuum cleaner hoses are known in the art, wherein the support carrier is connected to the hose by a thermoplastic material applied in an injection procedure. The end socket is attached in the same way in the hose. The material employed for attaching the support carrier on the hose and for attaching the end socket in the hose is either identical or similar to the material of the hose such that connections made with said material fulfill their purpose. The connections cannot be disengaged or detached free of destruction. The injection procedure is expensive, requires skilled personnel and special devices for performing the procedure.

SUMMARY OF THE INVENTION

1. Purposes of the Invention

It is a purpose of the present invention to provide for a vacuum-cleaner hose, not requiring an injection procedure for a connecting of a connection of the support carrier and of an end socket to a hose.

It is a further purpose of the present invention to provide for a vacuum cleaner hose, allowing a trained worker to perform a connection of the support carrier and of the end socket to the hose without large auxiliary means and that the connection can be detached again when desired or required.

These and other objects and advantages of the present invention will become evident from the description which follows.

2. Brief Description of the Invention

The present invention provides for a vacuum-cleaner hose with electrical conductors. A hose is made of a soft thermoplastic material and exhibits spiral, screw-like wave crests and wave troughs at its outer face. A support carrier is attached at one end of the hose. The support carrier is made out of a harder material than the material of the hose. The support carrier is formed of a socket ring and a sleeve disposed in front of the socket ring. A continuous axial slot is provided at the sleeve. At least one slip ring is placed onto the socket ring, and two additional slip rings are placed onto the sleeve. An end socket is inserted into the one end of the hose exhibiting the support carrier. The end socket is connected to the support carrier and is made of the same material as the support carrier. The sleeve is connected on the one hand form-matchingly to the socket ring and on the other hand form-matchingly to the and socket. At least one thread turn is formed at an inner jacket face of the sleeve. The thread turn forms a counter thread for the wave troughs and the wave crests of the hose. Electrical conductors are provided, wherein one of the electrical conductors is in each case connected to one slip ring. A protective casing is disposed in the hose. Ends of the electrical conductors are guided out of the protective casing, first into the axial slot of the sleeve and then to the slip rings, coordinated to the ends of the electrical conductors and openly disposed inside the axial slot.

An outer bead can be formed at the socket ring. A rear inner groove can be disposed at the sleeve. An annular collar can be formed at an outer face of the end socket. A front inner groove can be disposed at the sleeve. The outer bead can engage and grip into the rear inner groove of the sleeve, and the annular collar can engage and grip into the front inner groove of the sleeve for a form-matching connection of the sleeve to the socket ring and to the end socket.

A slot can be disposed at the end socket. The slot of the end socket can start at a rear end of the end socket and extend up to the annular collar. A tubular formation can be formed by flanks of the slot of the end socket for receiving coordinated ends of the protective casing. The formation can be open toward an open end of the slot of the end socket and closed at an opposite end. The slot of the end socket can be aligned with the axial slot of the sleeve in its deployed position.

A formed-on moving joint can subdivide the sleeve into two equal shell halves, wherein free edges of the shell halves form flanks of the axial slot.

A support carrier for an electrical slip ring, made of a material harder than the hose, is disposed at one end of the hose and one of the electrical conductors is connected in each case to an electrical slip ring. An end socket is plugged into the end of the hose exhibiting the support carrier. The end socket is connected to the support carrier and is made of the same material as the support carrier.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
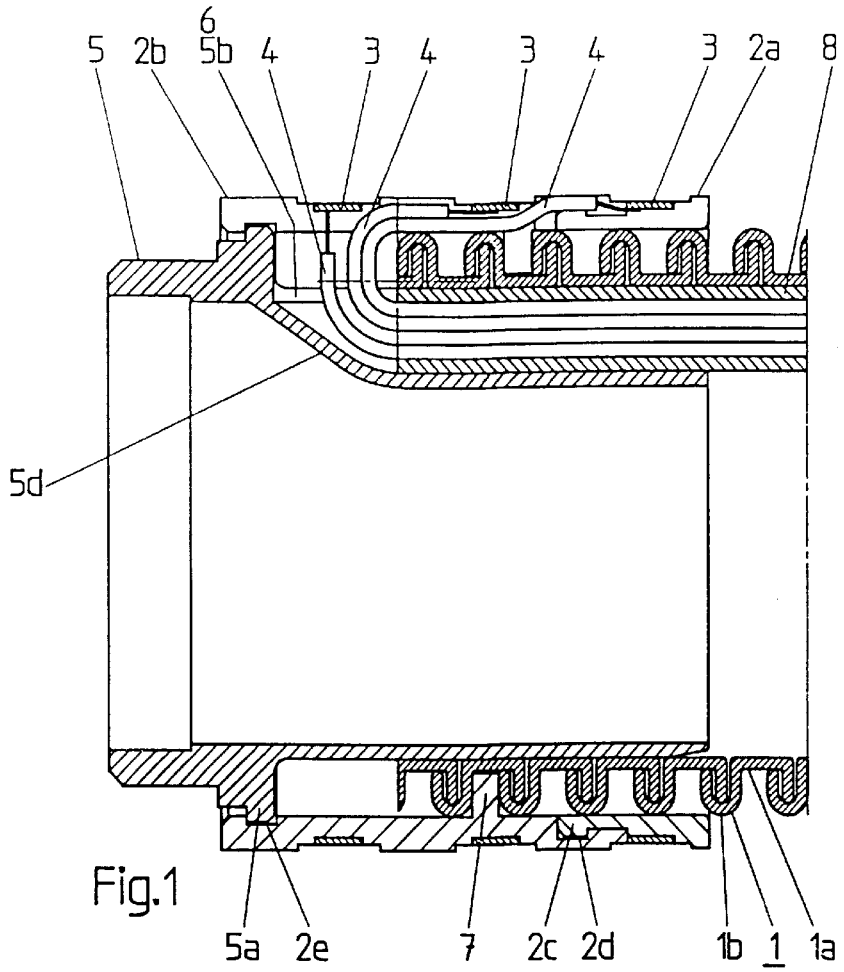
FIG. 1 is a sectional view of one part of a vacuum-cleaner hose.

A hose 1 made of a soft thermoplastic plastic material is shown in FIG. 1, wherein the hose 1 exhibits at its outer face spiral, screw-like wave troughs 1*a* and wave crests 1*b*.

In strip shape, the soft thermoplastic material is to be particularly easily expandable and tractile, and flexible and pliable in order to furnish a particularly flexible hose, wherein the wall of the hose is easily tensioned upon a bending in the zone subjected to tensile forces and is easily crushed and/or upset in the pressure zones.

A support carrier 2*a*, 2*b* for electrical slip rings 3, made of a harder plastic material than the material of the hose 1, is fastened on the hose 1. The support carrier 2*a*, 2*b* is made of a deflection-resistant material. The slip ring 3 is formed like a radial tube section and is made of a material, such as copper or a brass alloy, exhibiting good electrically conducting properties.

An electrical conductor 4 is in each case connected to the slip rings 3. The conductors 4 are disposed in the hose in a way described in greater detail below. The electrical conductor 4 is made of a copper strand or braid, which is enveloped by an insulating sleeve or covering.

An end socket 5 engages in the hose 1, wherein the assembled end of the end socket 5 is secured against easy removal.

The end socket 5 has such a length that the hose 1 in its assembled position is covered by from about four to five windings or winding turns of the hose.

Figure 6:
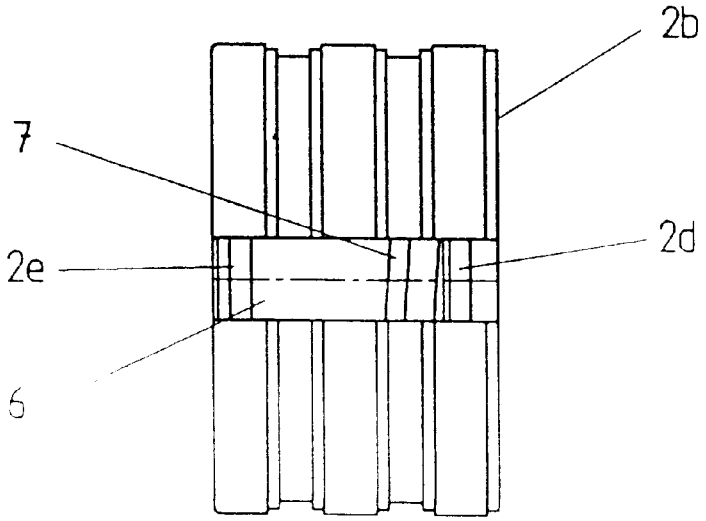
FIG. 6 is a sectional view of the sleeve of the support carrier shown in FIG. 1.
Figure 7:
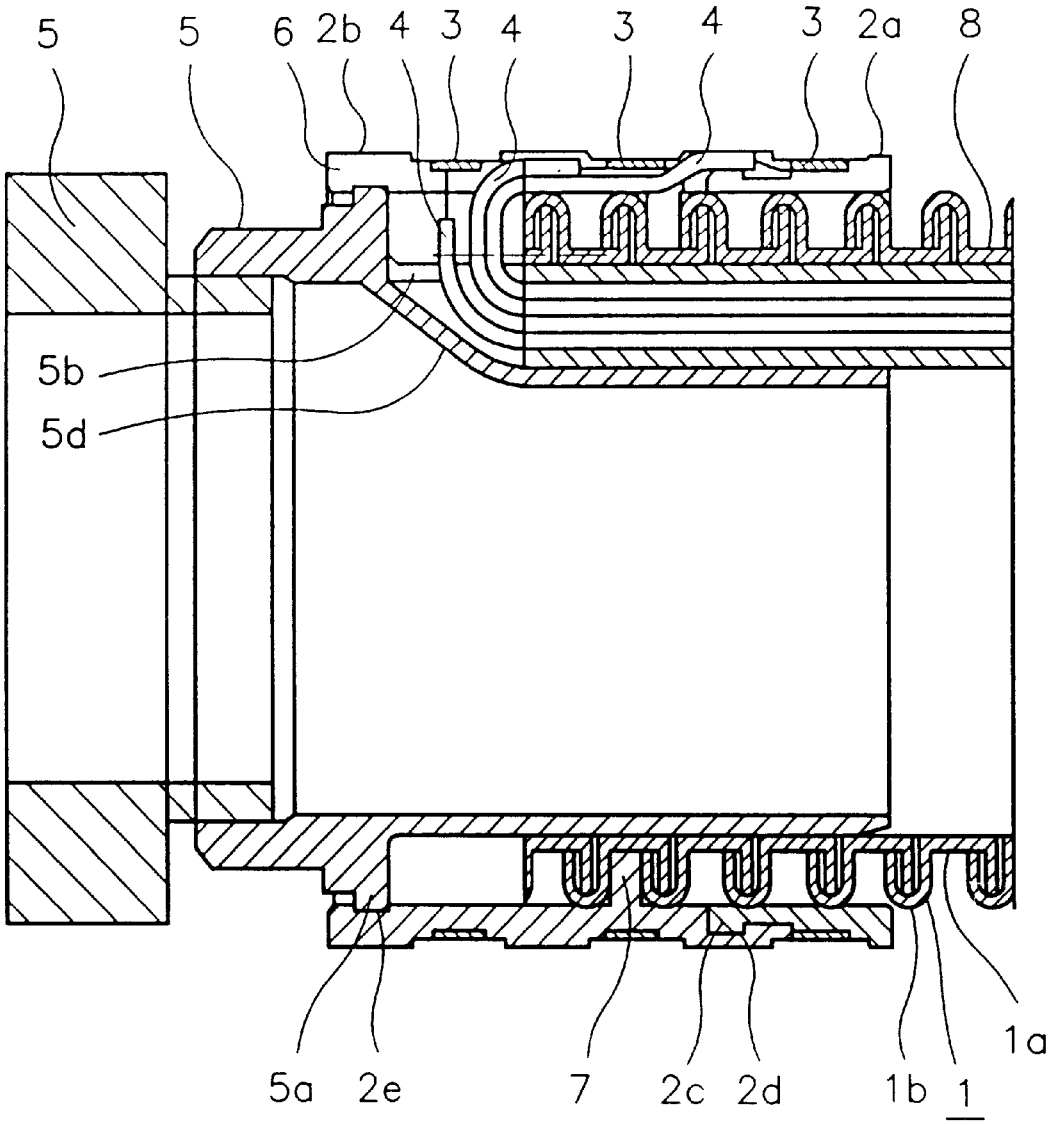
FIG. 7 is a sectional view of the embodiment of a vacuum cleaner hose according to FIG. 1, however also showing an end socket adapted to the vacuum cleaner hose.

The support carrier 2*a*, 2*b* is formed of two parts. The first part of the support carrier 2*a*, 2*b* is a socket ring 2*a*, wherein the socket ring 2*a* is provided with a slip ring 3 and exhibits a circumferentially closed jacket. The slip ring 3, coordinated to the support carrier 2*a*, is disposed in a circumferential groove channel of the support carrier 2*a*. The second part of the support carrier 2*a*, 2*b* is formed of a sleeve 2*b*, disposed in front of the socket ring 2*a*. The sleeve 2*b* is provided with two additional slip rings 3. The sleeve 2*b* exhibits a through-going and continuous axial slot 6 (FIGS. 1 and 6). The sleeve 2*b* has its own circumferential groove or channel for each one of the slip rings 3 carried by the sleeve 2*b*. The axial slot 6 is formed like a wide longitudinal section through and/or of a piece of pipe.

Figure 3:
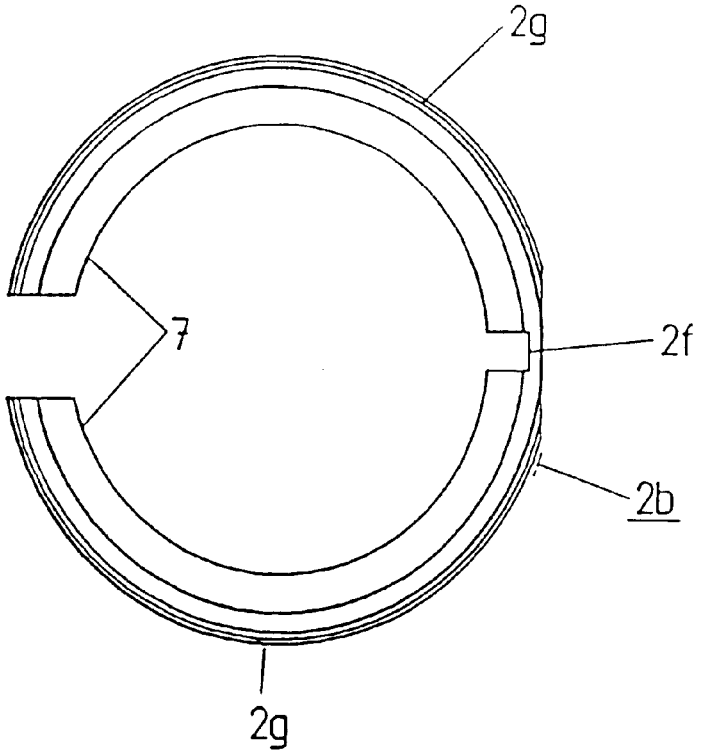
FIG. 3 is a front view of a component of a sleeve in its deployed form.

At least one thread turn 7 (FIGS. 3 and 4) is formed at the inner jacket face of the sleeve 2*b*. The thread turn 7 is a thread turn of a female screw. The cross-section of the thread turn is approximately rectangular. The spiral, screw-like groove formed on the outer face of the hose furnishes the male screw part. The thread turn 7 forms a counter thread for the wave troughs 1*a* and the wave crests 1*b* of the hose 1. The sleeve 2*b* is screwed onto the hose 1 after the socket ring 2*a* has been slid onto the hose 1.

The hose 1 is wound from a tape, wherein the tape exhibits a hook-like formed longitudinal edge, formed as a radial web, and an axial web, wherein the axial web connects the hook-like longitudinal edge and the longitudinal edge formed as radial web. As seen in FIG. 1 the tape is furnished on its two edges with a web each, wherein the first web is a projection at about a right angle, and wherein the second web has a cross-section of a hook. The hook is disposed such that immediately adjacent to the edge of the tape a channel recess is formed running side by side with the tape. The projection direction of the webs are the same relative to the plane of the tape. The height of the first web is about 0.4 to 0.8 times the width of the tape. The second web with a hook-like cross-section forms a female channel to be engaged by the already positioned first web of a previously disposed spiral of the tape. Thus, the inner depth of the channel of the second web substantially corresponds to the perpendicular height of the first web. For this purpose, the tape is spirally wound like a screw or helix such that the hook-like formed longitudinal edge of one tape winding continuously engages the radial and perpendicular web of the neighboring tape winding. In order to achieve a smooth interior wall of the hose, the axial web of the tape runs parallel to the hose axis. The hook-like formed edge of the tape is rounded toward the outside such that the tape windings form some kind of round thread, as shown in FIG. 1. The axial web of the tape is about equal in length to the height of the hook-like deformation of a tape edge or of the second web. The length of the axial web determines the slope or pitch of the spiral, screw-like windings. The axial web of the tape corresponds to the width, of the tape not counting the width furnished by the groove formed by the hook-shape adjacent to the edge of the tape.

The ends of the electrical conductors 4 are guided out of a protective casing 8 (FIG. 1), disposed in the hose 1, and the ends of the electrical conductors 4 are then guided first into the axial slot 6 of the sleeve 2*b* and then to the slip rings 3, coordinated to the ends of the electrical conductors 4, wherein the slip rings 3 are openly disposed inside the axial slot 6. The protective casing 8 is made of a tube which has a smooth inner surface and a smooth outer surface, wherein said tube is attached at the inner side of the hose 1 parallel to the longitudinal axis of the hose 1. The socket ring 2*a* is form-matchingly connected to the sleeve 2*b*. A circumferential outer bead 2*c*, formed at the socket ring 2*a*, engages and grips into a corresponding rear inner groove 2*d* of the sleeve 2*b* for furnishing a form-matching connection, as shown in FIG. 1. The outer bead 2*c* is an annular or ring-shaped projection, about rectangular in its cross-section, at the left-hand end of the socket ring 2*a* (FIG. 1). The rear inner groove 2*d* and the front inner groove 2*e* are formed as annular recesses.

An annular collar 5*a*, formed at the outer face of the end socket 5, engages and grips into a front inner groove 2*e* of the sleeve 2*b*, as shown in FIG. 1. The annular collar 5*a* is formed as an annular, ring-shaped projection having a rectangular shape in cross-section and projecting radially outwardly.

The socket ring 2*a* and the end socket 5 are form-matchingly connected to each other based on the engagement and gripping of the outer bead 2*c* of the socket ring 2*a* into the rear inner groove 2*d* of the sleeve 2*b* and the engagement and gripping of the annular collar 5*a* into the front inner groove 2*e* of the sleeve 2*b*. The connection of the sleeve 2*b* to the hose 1 is also form-matching based on the screw action of the thread turn 7 into the hose 1 between two neighboring hook-shaped webs such that the connections as a whole are purely form-matching, and wherein the connection can however be detached again if necessary or required.

Figure 2:
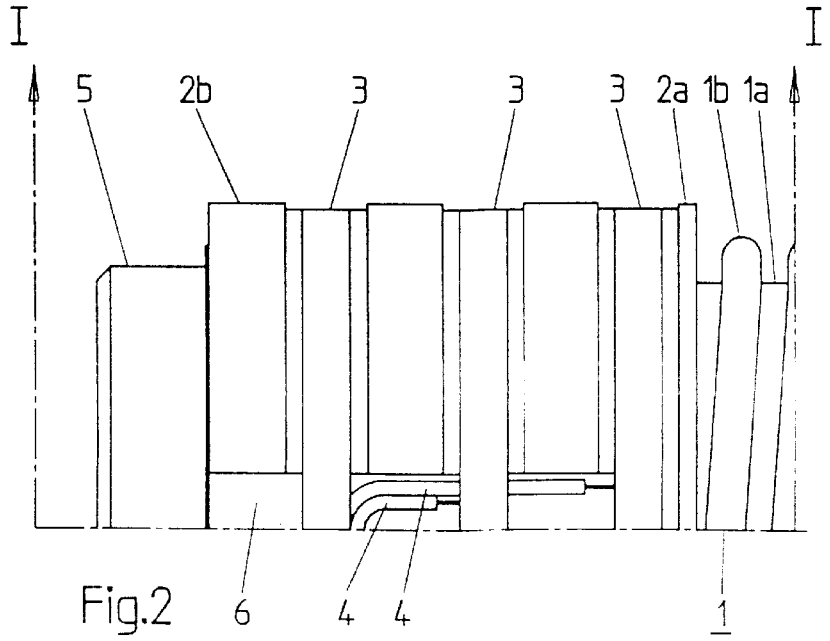
FIG. 2 is a sectional view of the vacuum cleaner hose showing the course of the section shown in FIG. 1.
Figure 5:
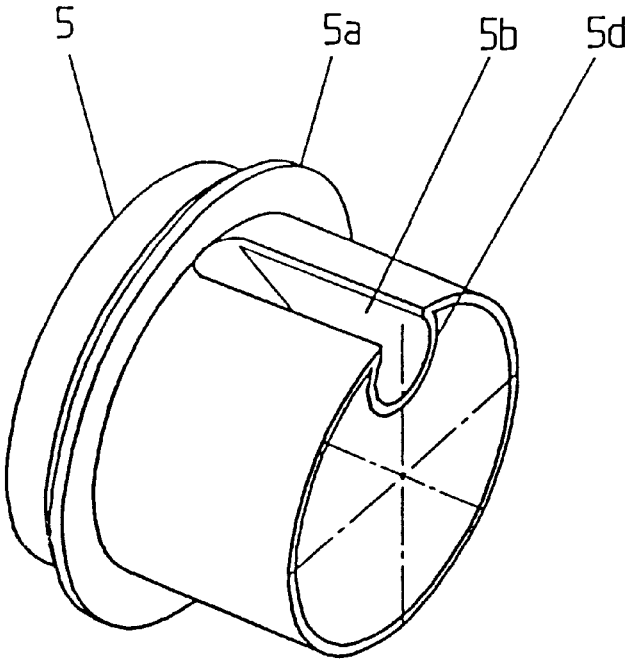
FIG. 5 is a sectional view of the embodiment of the part of a vacuum cleaner hose according to FIG. 1, however also showing an end socket adapted to the vacuum cleaner hose.

A slot 5*b*, shown in FIG. 1, is provided in the end socket 5 as an additional embodiment of the invention, wherein the slot 5*b* starts at the rear end of the end socket 5 and extends up to the annular collar 5*a* (FIG. 5). The slot 5*b* is formed as a rectangular slot extending from the rear end of the end socket 5 to the back of the annular collar 5*a* of the end socket 5. The flanks of the slot 5*b* pass over into a tubular formation 5*d*, wherein the tubular formation 5*d* is provided for receiving the coordinated ends of the protective casing 8 (FIG. 5). The formation 5*d* is open toward the open end of the slot 5*b* and is closed at the opposite end. The tubular formation 5*d* is formed like a tube provided with a longitudinal slot. The longitudinal slot converges with the longitudinal slot 5*b* (FIG. 5). The slot 5*b* is preferably directed such in its destination position that the slot 5*b* is aligned with the axial slot 6 (FIGS. 1 and 2) of the sleeve 2*b* (FIG. 6). This provides for an installation path for the electrical conductors 4, as is shown in FIG. 1.

Figure 4:
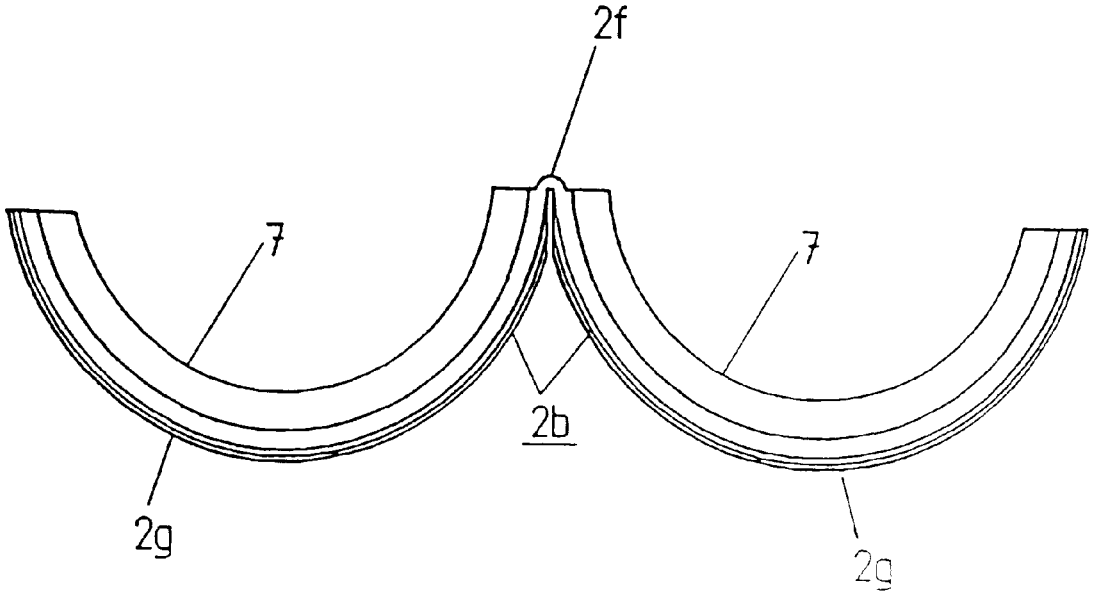
FIG. 4 is a front view of the component of the sleeve shown in FIG. 3 in its production form.

In addition, a suitable further improvement of the object of the invention is provided in that a formed-on moving joint 2*f* (FIGS. 3 and 4) subdivides the sleeve 2*b* into two equal shell halves 2*g*, wherein free edges of the shell halves 2*g* form the flanks of the axial slot 6. The formed-on moving joint 2*f* is a joining position running in axial direction of the shell halves 2*g* and connecting the shell halves 2*g*, and the formed-on moving joint 2*f* exhibits an about rectangular, thinned cross-section, wherein the cross-section is flexible crosswise to the longitudinal direction of the cross-section. The shell halves 2*g* are formed like a tube, wherein the tube is separated into two parts along its axis, wherein the two parts are connected at the formed-on moving joint 2*f*. Thus, the sleeve 2*b*, as shown in FIG. 4, is to be produced in a flipped-open form, wherein a simple slider-free form suffices for this purpose. In order to achieve the deployed form of the sleeve 2*b*, it is merely necessary to move the two shell halves 2*g* around the moving joint 2*f* toward each other until there results the deployed form illustrated in FIG. 3.

It will be understood that each of the elements described above, or two or more together, may also find a useful application in other types of suction hoses differing from the types described above.

While the invention has been illustrated and described as embodied in the context of a vacuum-cleaner hose with electrical conductors, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

1. A vacuum-cleaner hose with electrical conductors, comprising a hose made of a soft thermoplastic material and exhibiting spiral, screw-like wave crests and wave troughs at an outer face;

a support carrier attached at one end of the hose, wherein the support carrier is made out of a harder material than the material of the hose, and wherein the support carrier is formed of a socket ring and a sleeve disposed in front of the socket ring;

a continuous axial slot provided at the sleeve;

at least one slip ring placed onto the socket ring, and two additional slip rings placed onto the sleeve;

an end socket inserted into the one end of the hose exhibiting the support carrier, wherein the end socket is connected to the support carrier and is made of the same material as the support carrier, and wherein the sleeve is connected on the one hand form-matchingly to the socket ring and on the other hand form-matchingly to the end socket;

at least one thread turn formed at an inner jacket face of the sleeve, wherein the thread turn forms a counter thread for the wave troughs and the wave crests of the hose;

electrical conductors, wherein one of the electrical conductors is in each case connected to one slip ring;

a protective casing disposed in the hose, wherein ends of the electrical conductors are guided out of the protective casing, first into the axial slot of the sleeve and then to the slip rings, coordinated to the ends of the electrical conductors and openly disposed inside the axial slot.

2. The vacuum-cleaner hose according to claim 1, further comprising an outer bead formed at the socket ring;

a rear inner groove disposed at the sleeve;

an annular collar formed at an outer face of the end socket;

a front inner groove disposed at the sleeve, wherein the outer bead engages and grips into the rear inner groove of the sleeve, and the annular collar engages and grips into the front inner groove of the sleeve for a form-matching connection of the sleeve to the socket ring and to the end socket.

3. The vacuum-cleaner hose according to claim 2, further comprising a slot disposed at the end socket, wherein the slot of the end socket starts at a rear end of the end socket and extends up to the annular collar;

a tubular formation formed by flanks of the slot of the end socket for receiving coordinated ends of the protective casing, wherein the formation is open toward an open end of the slot of the end socket and closed at an opposite end, and wherein the slot of the end socket is aligned with the axial slot of the sleeve in its deployed position.

4. The vacuum-cleaner hose according to claim 3, further comprising a formed-on moving joint subdividing the sleeve into two equal shell halves, wherein free edges of the shell halves form flanks of the axial slot.

5. A vacuum-cleaner hose with electrical conductors, wherein a) a hose is made of a soft thermoplastic material and exhibits at an outer face spiral, screw-like wave crests and wave troughs, and wherein a support carrier, made out of a harder material than the material of the hose, is attached at one end of the hose for electrical slip rings, wherein one of the electrical conductors is in each case connected to the slip rings;

b) an end socket is inserted into the end of the hose exhibiting the support carrier, wherein the end socket is connected to the support carrier and is made of the same material as the support carrier, wherein c) the support carrier is made of a socket ring (2*a*), provided with at least one slip ring (3), and a sleeve (2*b*), disposed in front of the socket ring (2*a*), wherein the sleeve (2*b*) is provided with a continuous axial slot (6) and includes two additional slip rings (3), and wherein the sleeve (2*b*) is connected on the one hand form-matchingly to the socket ring (2*a*) and on the other hand form-matchingly to the end socket (5);

d) at least one thread turn (7) is formed at an inner jacket face of the sleeve (2*b*), wherein the thread turn (7) forms a counter thread for the wave troughs (1*a*) and the wave crests (1*b*) of the hose (1);

e) ends of the electrical conductors (4) are guided out of a protective casing (8), disposed in the hose (1), first into the axial slot (6) of the sleeve (2*b*) and then to the slip rings (3), coordinated to the ends of the electrical conductors (4) and openly disposed inside the axial slot (6).

6. The vacuum-cleaner hose according to claim 5, wherein an outer bead (2*c*), formed at the socket ring (2*a*), engages and grips into a rear inner groove (2*d*) of the sleeve (2*b*) and an annular collar (5*a*), formed at an outer jacket surface of the end socket (5), engages and grips into a front inner groove (2*e*) of the sleeve (2*b*) for a form-matching connection of the sleeve (2*b*) to the socket ring (2*a*) and to the end socket (5).

7. The vacuum-cleaner hose according to claim 6, wherein the end socket (5) includes a slot (5*b*), starting at a rear end of the end socket (5) and extending up to the annular collar (5*a*), wherein flanks of the slot (5*b*) pass over into a tubular formation (5*d*), formed for receiving coordinated ends of the protective casing (8), wherein the formation (5*d*) is open toward an open end of the slot (5*b*) and closed at an opposite end, and wherein the slot (5*b*) is aligned with the axial slot (6) of the sleeve (2*b*) in its deployed position.

8. The vacuum-cleaner hose according to claim 7, wherein a formed-on moving joint (2*f*) subdivides the sleeve (2*b*) into two equal shell halves (2*g*), wherein free edges of the shell halves (2*g*) form flanks of the axial slot (6).

* * * * *